United States Patent [19]

Schultz

[11] Patent Number: 4,545,143

[45] Date of Patent: Oct. 8, 1985

[54] TRIGGER MECHANISM FOR DOUBLE BARREL SHOTGUN

[76] Inventor: Mitchell D. Schultz, 57 Unquowa Rd., Fairfield, Conn. 06430

[21] Appl. No.: 545,046

[22] Filed: Oct. 24, 1983

[51] Int. Cl.[4] ..... F41C 7/00; F41C 19/00

[52] U.S. Cl. ..... 42/42 R

[58] Field of Search ..... 42/42 R

[56] References Cited

U.S. PATENT DOCUMENTS

| | | | |
|---|---|---|---|
| 3,389,488 | 6/1968 | Beretta | 42/42 R |
| 3,421,243 | 1/1969 | Browning | 42/42 R |
| 3,537,203 | 11/1970 | Weatherby et al. | 42/42 R |
| 4,265,044 | 5/1981 | Beretta | 42/42 R |
| 4,310,981 | 1/1982 | Waddell | 42/42 R |

*Primary Examiner*—Charles T. Jordan
*Assistant Examiner*—Ted L. Parr
*Attorney, Agent, or Firm*—Kramer and Brufsky

[57] ABSTRACT

A multiple barrel firearm having "over-and-under" barrels or "side-by-side" barrels is adapted to have individual ones of the barrels fired by successive pulls of a single trigger. Upon discharge of one of the barrels a recoil and counter-recoil responsive means, such as an inertia block pivotably mounted on the trigger is mechanically positioned to engage a hammer trip lever associated with the second barrel to assure that the second barrel is fired upon a successive pull of the trigger. This is accomplished by thrusting a cam lug into the path of movement of the recoil and counter-recoil responsive means during its counter-recoil movement so as to disengage it from means normally holding the recoil and counter-recoil responsive means out of engagement with the trip lever prior to firing of the first barrel.

5 Claims, 10 Drawing Figures

TRIGGER MECHANISM FOR DOUBLE BARREL SHOTGUN

BACKGROUND OF THE INVENTION

1. Field Of The Invention

The present invention relates generally to double-barrel shotguns of the "side-by-side" and "over-under" varieties, and more particularly, to a trigger mechanism for such shotguns which assures that each barrel is fired upon successive actuation of the finger pull of the trigger mechanism.

2. Description Of The Prior Art

Double-barrel firearms, such as shotguns which use but a single trigger to fire both barrels have been manufactured for a number of years. Usually, two hammers are provided and a sear cooperates with each of the hammers, which when rotated will release its associated hammer to strike a firing pin. A manually adjustable selector is provided so that selection can be made between the firing of one barrel or the other of the double-barrelled weapon or firearm by the use of a single trigger. The mechanism of the selector precludes the unselected barrel from being prematurely fired by precluding contact of the trigger with the sear mechanism associated with the hammer for firing the barrel, whioh upon rotation, would normally free the hammer associated with the unfired barrel for counterclockwise rotation against a firing pin. The unselected barrel is usually fired upon a successive pull of the trigger mechanism by providing a recoil and counter-recoil responsive member such as an inertia block pivotably mounted on the trigger, which upon firing of the first barrel, will move upon recoil relative to a holding member to be released from engagement therewith, and then upon counter-recoil into rotational engagement with the sear mechanism associated with the hammer for firing each barrel. Upon subsequent pull of the single trigger mechanism, the second barrel is fired upon rotation of its associated sear mechanism which results in release of the second hammer (the first hammer already having been fired). Examples of such trigger mechanisms are shown in U.S. Pat. No. 3,537,203 issued on Nov. 3, 1970 to Weatherby et al; U.S. Pat. No. 3,421,243, issued Jan. 14, 1969 to Browning; and U.S. Pat. No. 3,389,488 to Beretta issued June 25, 1968.

As indicated in U.S. Pat. No. 3,389,488 the manual barrel selector is primarily used to overcome misfiring of the first or selected barrel by moving the selector to its second position into rotational contact with the sear associated with the second hammer, whereupon the firing procedure is repeated and the recoil and counter-recoil responsive member relied upon to produce firing of the second barrel upon successive pulls of the trigger. However, in skeet shooting and other related sports, where time to fire is critical by being limited, such manual reselection and aiming of the weapon, is insufficient to overcome the effects of misfiring of the weapon.

Furthermore, it is not uncommon for the inertia block or recoil and counter-recoil responsive member not to be released from the holding member upon recoil and counter-recoil of the weapon thereby resulting is misfiring of the weapon upon a second pull of the trigger, because the inertia block is not allowed to engage the sear mechanism associated with the second hammer.

Alternatively, elimination of the holding means for the inertia block will result in "doubling", that is, the simultaneous firing of each barrel upon a single pull of the trigger mechanism, because the inertia block will simultaneously engage each sear mechanism prior to the first trigger pull.

This invention provides a means for eliminating such problems and assures successive firing of the individual barrels of a double-barrel shotgun upon successive pulls of a single trigger.

SUMMARY OF THE INVENTION

In accordance with this invention, the engagement of the recoil and counter-recoil responsive inertia block with the sear mechanism associated with the percussion hammer for firing the second barrel of the shotgun is accomplished positively and mechanically as the first barrel is fired upon pulling the trigger mechanism. Engagement of the inertia block with the sear mechanism does not rely upon the conventional recoil and counter-recoil movement of the inertia block which theoretically enables the inertia block to become disassociated from its holding member and then thrust forward into engagement with the sear so that upon successive pulling of the trigger mechanism, the sear associated with the second hammer and second barrel can be released by subsequent relative rotation of the trigger mechanism, inertia member, and sear.

Rather, the manual selector is fixed to assure that the trigger mechanism will engage and contact the sear associated with the firing of the first hammer and barrel upon pull of the trigger. A cam having an upstanding lug or ear is substituted for a portion of the second sear mechanism and interposed between the inertia block and its holding member during movement of the inertia block upon pulling of the trigger to fire the first barrel to cause positive separation of the holding member from the inertia block and positioning of the inertia block into contact with the remaining rotational sear mechanism associated with the first and second barrel of the shotgun, upon recoil and counter-recoil of the gun. Therefore, misfiring of the second barrel is precluded because the inertia block is positively enabled to engage with the the sear associated with the second barrel. "Doubling" is also avoided because the holding member is not disassociated from the inertia block until after the firing of the first barrel which is therefore retained out of engagement with the sear mechanism associated with each hammer until after the first trigger pull, which rotates the sear and its associated first percussion hammer to enable counterclockwise movement of the hammer to strike the firing pin associated with the first barrel.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
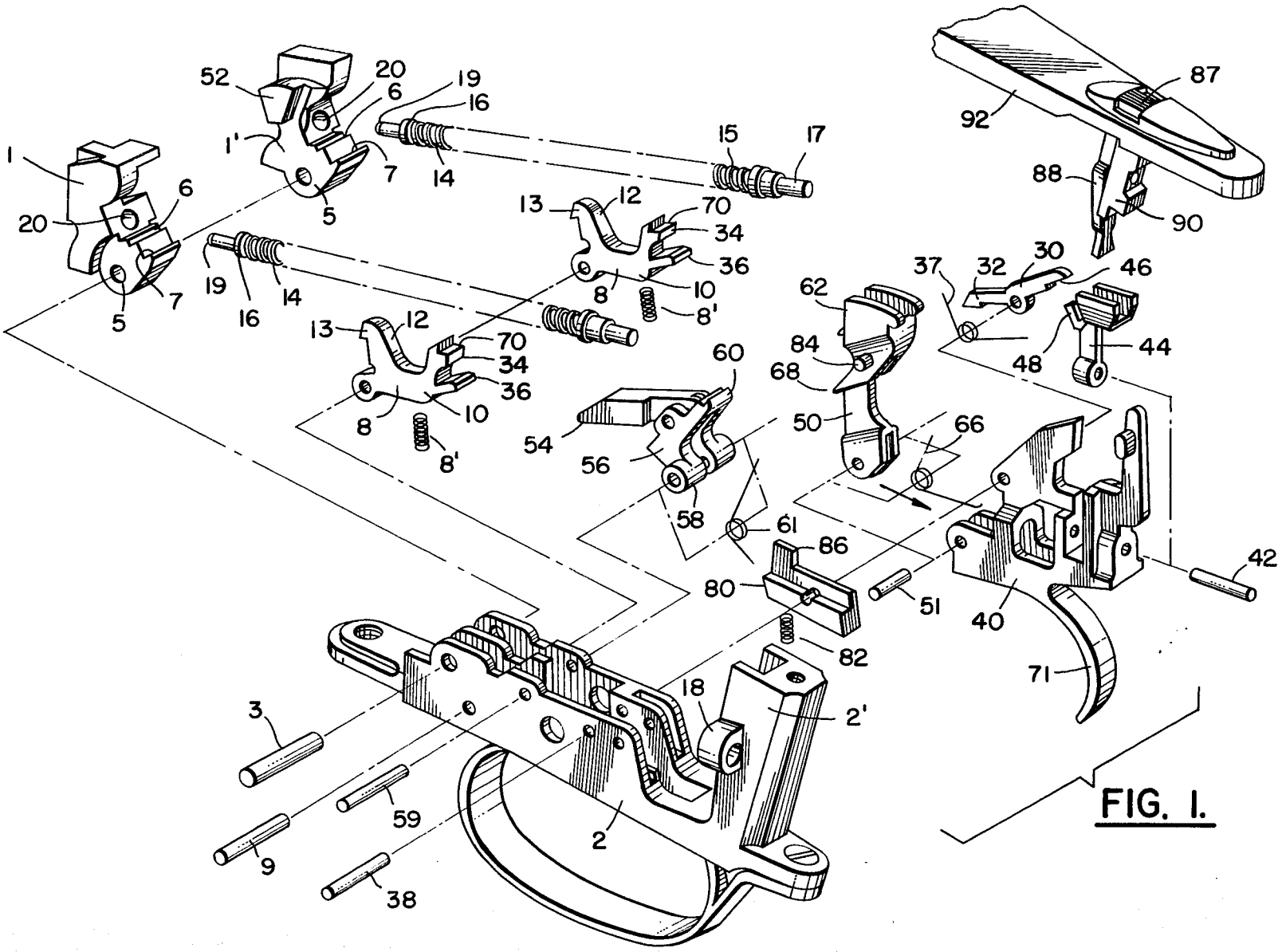
FIG. 1 is an exploded perspective view of the trigger mechanism of the present invention.

Referring now to the drawings in detail, wherein like numerals indicate like elements throughout the several views, the reference characters 1 and 1' generally designate the two hammers of an "over-under" double-barrel shotgun or a "side-by-side" double-barrel shotgun. The hammers 1 and 1' are pivoted on the underguard 2 by means of a transverse pin 3, so as to be angularly displaced to and from a respective striker or firing pin (not shown).

Figure 3:
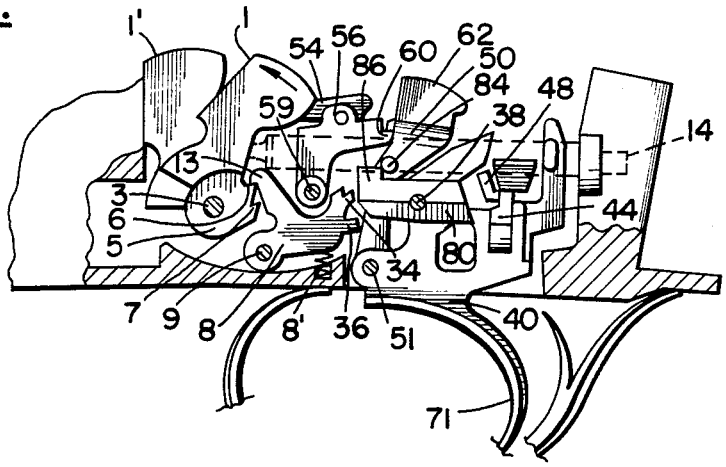
FIG. 3 is a view similar to FIG. 2 with the first barrel of the weapon fired as the finger pull of the trigger mechanism is depressed or pulled.
Figure 4:
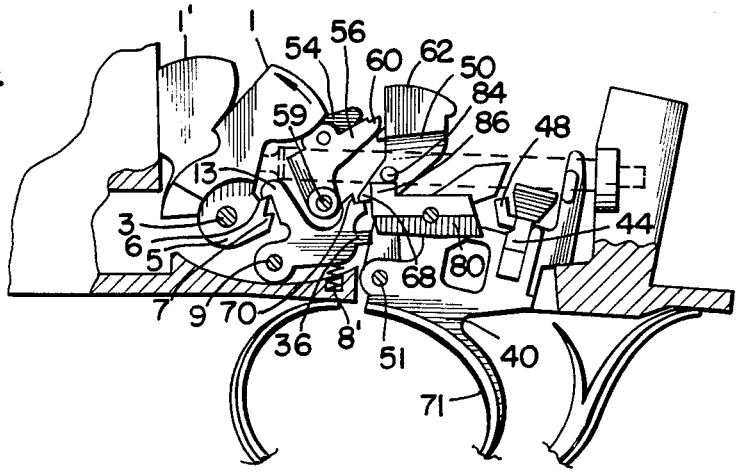
FIG. 4 is a view similar to FIGS. 2 and 3 with the second barrel of the weapon ready to be fired.

The hammers 1 and 1' have, on their rearwardly facing surface an intermediate height, step-like portion 5 on which there are located two trip teeth 6, 7, one positionally following the other and positioned in a plane which is above the pivoting axis of the hammers 1 and 1' when the hammers are in their released position, such as shown for example in FIGS. 3 and 4. One of the teeth, for example tooth 6, is so constructed as to define the arming position of each hammer 1 and 1' while the other tooth 7 constitutes a means for safety-positioning of the hammers 1 and 1' as described hereinafter.

Each hammer 1 and 1' has associated therewith a respective trip lever 8 pivoted on the underguard 2 by means of a pin 9 and having a first portion 10 and a second portion 12.

The first portion 10 of the right hand trip lever 8 is substantially horizontal in the armed position of its associated hammer 1' and faces and cooperates with a trigger assembly generally indicated by the numeral 11 and a spring-biased sear 30 which has a front portion or ratchet 32 engaged between the rearwardly extending teeth 34 and 36 on the right hand trip lever 8 associated with the hammer 1'.

The second portion 12 of each of the trip levers 8 is directed upwardly and positioned behind each of the hammers 1 and 1' and has a frontwardly facing projection 13 which engages alternately, one or the other of the teeth 6, 7 of its adjacent respective hammer 1 or 1'. Each trip lever 8 is in turn urged by a compression spring 8' in a clockwise direction by acting upwardly in a substantially vertical direction between the underguard 2 and trip lever 8, so as to keep the portion 12 thereof constantly adjacent to the associated hammer 1 or 1' with the projection 13 in engagement with one of the teeth 6, 7 of hammer 1 or 1'.

The tooth 6 allows the blocking of the hammer 1 and 1' in the correct armed position, which is achievable by means of a full opening of the barrels of the firearm as is well known in the art. The tooth 7 serves to arrest the hammer 1 and 1' in the event of an incomplete arming of the hammer 1 caused by a partial opening of the barrels. In this case, the projection 13 of the trip lever 8 engages the tooth 7 and ensures the blockage of the hammer 1 so as to prevent the uncontrolled or accidental action of the striker and the corresponding firing of the cartridge.

Furthermore, the tooth 7 also serves as engagement means with the trip lever 8, when tooth 6 is worn and there is no possibility of a sure engagement of the projection 13 of the trip lever 8 with the arresting tooth 6. There is, therefore, achieved a greater safety in the operation of the mechanism and, consequently, the elimination of any possible uncontrolled or accidental release of the hammer 1 or 1'.

Each hammer 1 and 1' is associated with a trip spring 14 of predetermined regulated load so as not to bias the hammer 1 or 1' when the latter is in a rest position, i.e., when the hammer 1 or 1' has already released, so as to keep the hammer from biasing its associated striker. To this end, the spring 14 is mounted on a guide rod 15 and is arrested with a pre-load between a striking collar 16 provided in the vicinity of one of the terminals of the guide rod and an internally threaded regulating sleeve 17 threaded on to the opposite extremity or terminal of the guide rod 15.

Furthermore, while the threaded extremity of the rod 15 is guided within an opening provided in a ring 18 of the support 2' of the underguard 2, the opposed extremity of the guide rod 15 is provided with a hemispherically-shaped head 19 and is lodged in a seat 20 provided in the rear part of the hammer 1.

The pre-loading of the spring 14 is regulated by threading or unthreading the regulating sleeve 17 as desired, on the guide rod 15.

In this manner, when the hammer 1 or 1' is moved into the armed position, the spring 14 is compressed and is therefore "loaded" between the collar 16 of the guide rod 15 and a ring 18. Upon subsequent releasing of the hammer 1 or 1', the reaction of the spring 14 is unloaded on the guide rod 15 which then forceably moves the hammer 1 or 1' toward its associated striker for the firing thereof. Details of the hammer construction 1 and 1', trip levers 8, and trip springs 14 are shown in complete detail in U.S. Pat. No. 4,265,044 issued May 5, 1981 to Beretta, which disclosure is incorporated herein by reference.

Figure 2:
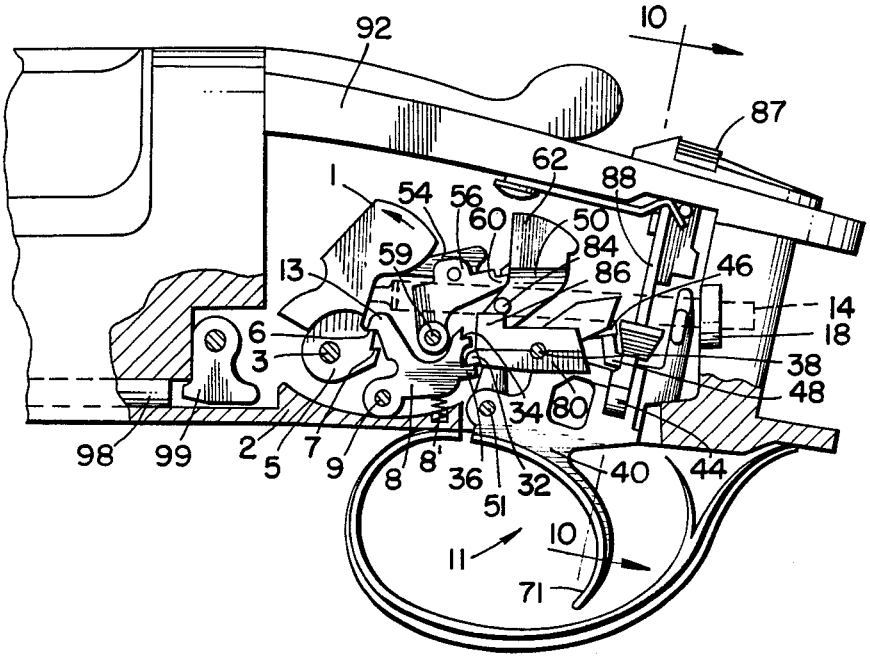
FIG. 2 is a side view in elevation, partly in section, of the trigger mechanism of the present invention in a fully cocked, or ready to fire position.
Figure 5:
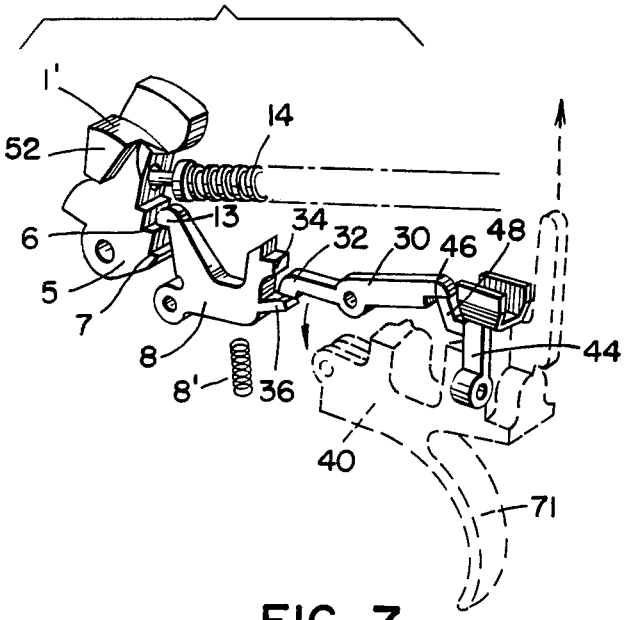
FIG. 5 is an exploded perspective view of the portions of the trigger mechanism used to fire the first barrel.
Figure 8:
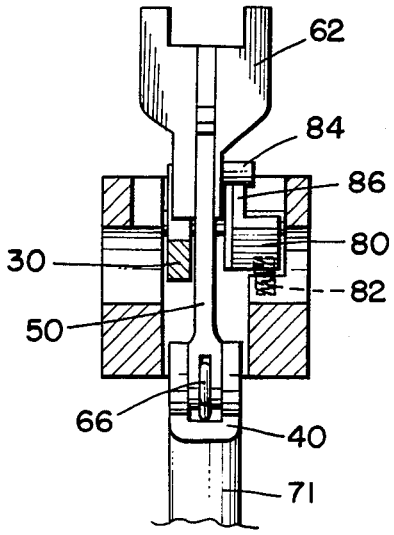
FIG. 8 is a cross-sectional view taken substantially along the plane indicated by line 8—8 of FIG. 7.
Figure 7:
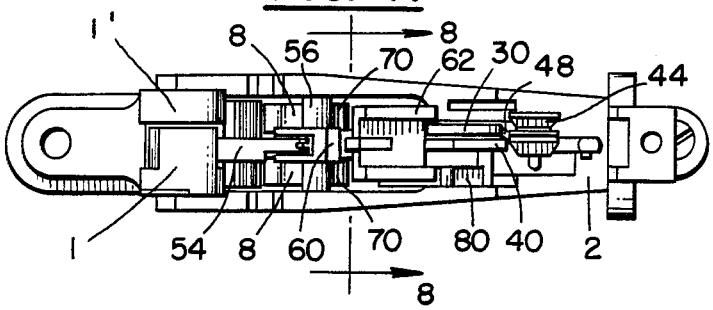
FIG. 7 is a top plan view of the trigger mechanism of FIGS. 3 to 4 after the firing of the second barrel.

As shown most clearly in FIGS. 2 and 5 sear 30 has its ratchet 32 engaged between the teeth 34 and 36 of the right hand trip lever 8 under the urging of a coil spring 37 mounted on a pin 38 adjacent the plane of sear 30. Pivoted on a horizontal pin 42 supported on the body 40 of the trigger assembly 11, which includes the trigger finger pull 71, is a selector body member 44. The body member 44 is positioned in fixed relation beneath the opposite stepped end 46 of sear 30 so that an inclined upwardly extending lug 48 on the body member 44 is placed in contact with the stepped end 46 of sear 30 when the firearm is cocked.

Figure 9:
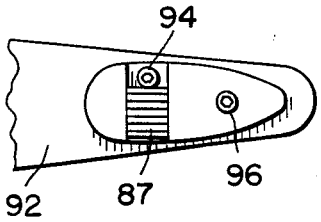
FIG. 9 is a partial top plan view of the selector mounted on the frame of the weapon.
Figure 10:
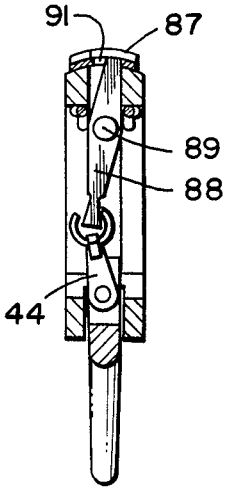
FIG. 10 is a cross-sectional view taken substantially along the plane indicated by line 10—10 of FIG. 2.

The body member 44 can be positioned beneath the stepped end 46 of sear 30 with a manual action on the knob-carrying end 87 of a lever 88, which is in contact with the top of body member 46 and is pivoted at 89 to the slide 90 (see FIG. 10) which can be slid within a slot 91 formed in the frame 92 of the firearm. Set screws 94 and 96 (see FIG. 9) preclude movement of knob-carrying end 87 of lever 88 once the selector lug 48 of body member 44 has been moved beneath the sear 30. The body member 44, slide 90, lever 88, and knob-carrying end 87 of the lever are all disclosed in U.S. Pat. No. 3,389,488 issued June 25, 1968 to Beretta as a means to selectively fire each barrel of a double-barrel shotgun, which disclosure is incorporated in its entirety by reference in the present application.

In the present invention, the selector body member 44 is fixed in position by set screws 94, 96 as indicated so that the lug 48 is always positioned beneath and in contact with the stepped end 46 of the sear 30 associated with the first to be fired barrel of the weapon.

Figure 6:
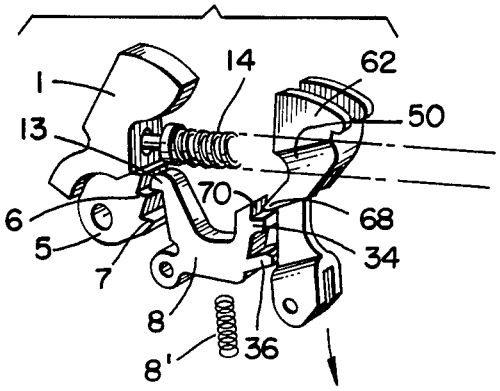
FIG. 6 is an exploded perspective view of the portion of the trigger mechanism used to fire the second barrel.

Pivotably mounted on a pin 51 extending through the front portion of the body 40 of trigger assembly 11 is an inertia block generally designated by the numeral 50. Normally, upon cocking of the firearm or weapon and the pivoting of each of the hammers 1 and 1' in a clockwise direction about the axis of pin 3, a block 52 integral with the right hand hammer 1' and bridging the space between the hammers 1 and 1' is adapted to contact a projection 54 extending forwardly from and pivotably mounted on the body 56 of a holding means generally designated by numeral 58. Holding means 58 is pivotably mounted on pin 59 on the underguard 2 in a vertical plane extending between the trip levers 8. Clockwise movement of the hammers 1 and 1' and block 52 will cause block 52 to strike projection 54 and rotate body 56 of holding means 58 against the urging of a coil spring 61 on pin 59, so that a rearwardly extending pawl portion 60 on the body portion 56 is located beneath the head 62 of inertia block 50 as illustrated in FIGS. 2 and 3. The contact of pawl 60 of holding means 58 beneath the head 62 of inertia block 50 pushes the inertia block rearwardly against the urging of a coil spring 66 on pin 51 so that a forwardly extending tooth portion or inclined shoulder 68 on inertia block 50 cannot normally engage the land 70 on the top of the teeth 34 on each of the trip levers 8 which is necessary for arming of the firing of the second barrel, as shown in FIGS. 4 and 6, and described hereinafter.

During normal operation for firing both barrels of the firearm, the lug 48 on the body member 44 would be positioned by knob 87 and lever 88 beneath the sear 30. Upon pulling finger pull 71 of trigger body 40, the sear 30 is rotated in a counterclockwise direction until the ratchet 32 clears the lower tooth 36 of the right hand trip lever 8, initially causing the lever 8 to rotate in a clockwise direction about the axis of pin 9 compressing its spring 8' causing the hammer 1' to rotate in a clockwise direction and then releasing the same enabling the spring 8' to rerotate the right hand trip lever in a counterclockwise direction about the axis of pin 9 until projection 13 disengages from teeth 6 and 7, freeing the hammer 1' so that spring 14 can be extended to rerotate the hammer 1' in a counterclockwise direction to cause contact with the striker of one of the barrels of the shotgun and discharge of the same.

During recoil, the head 62 of inertia block 50 would first rotate about the axis of pin 51 in a clockwise direction to disassociate itself from pawl 60 of holding means 58, allowing holding means 58 to rotate under the urging of spring 61 in a counterclockwise direction about the axis of pin 59 so that the pawl 60 would be freed to clear the head 62 of inertia member 50. Upon counter-recoil, the inertia block 50 would move in a counterclockwise direction under the urging of spring 66 so that its shoulder 68 would seat on and extend between the lands 70 of upper teeth 34 of trip levers 8. Upon pulling the finger pull 71 on the trigger body 40 again, the shoulder 68 of the inertia block would rotate the left hand trip lever (as well as right hand trip lever) 8 against the force of its compression spring 8' first in a clockwise direction until projection 13 on the front portion 12 of each trip lever cleared and released teeth 6 and 7 on hammers 1 and 1' (see FIG. 6). This would enable the left hand trip spring 14 to rotate the trip hammer 1 in a counterclockwise direction to fire the second barrel. Often, however, the pawl 60 would remain beneath the head 62 of inertia block 50 due to insufficient recoil and counter-recoil movement of the inertia block so that the inertia block shoulder 68 was precluded from being placed in contact with the lands 70 on upper teeth 34 on each trip lever 8, whereupon pulling the finger pull 71 of the trigger assembly 11 for a second time would have no effect and cause misfiring of the second barrel.

In order to remedy this situation, the positioning of the inertia block 50 with its shoulder 68 in contact with the lands 70 on the upper teeth 34 of each trip lever is accomplished mechanically in conjunction with the recoil and counter-recoil of the inertia block 50 by providing a cam element 80 pivotably mounted on the axis pin 38 between the underguard 2 and the trigger body 40 to cause positive disassociation of the inertia block 50 with the pawl 60 upon the first pull of trigger, rather than relying solely upon subsequent recoil and counter-recoil to position the shoulder 68 in contact with the lands 70 on the upper teeth 34 trip levers 8. Upon rear actuation of the finger pull 71 from the fully cocked position of FIG. 2 to the position illustrated in FIG. 3, the trigger body 40 will pivot in a counterclockwise direction about the axis of pin 38. A coil spring 82 between the underguard 2 and bottom of cam element 80 will hold the cam element in a substantially horizontal attitude relative to trigger body 40. The head 62 of inertia block 50 will move under the urging of pawl 60 rearwardly relative to trigger body 40 as the body pivots, until a pintle 84 extending laterally from the inertia block is positioned at least partially behind an upstanding lug or ear 86 on cam element 80, as shown in FIG. 3. The lug or ear 86 forms an obstruction in the path of movement of inertia block 50 upon recoil and counter-recoil so that the spring 61 can first rotate holding means 58 about the axis of pin 59, while projection 54 remains substantially horizontal, to cause pawl 60 to clear and become disengaged from beneath head 62 of inertia block. Upon release of finger pull 71, the released inertia block 50 can rotate in a counterclockwise direction with pintle 84 following an arcuate path over the top of lug or ear 86, until the shoulder 68 is seated on lands 70 of teeth 34 of each trip lever 8, as shown in FIG. 4. Upon subsequent pivoting of the trigger body 40 by depressing trigger pull 71, shoulder 68 causes rotation of the trip levers 8 in a clockwise direction against its spring 8' until the front projection 13 of front portion 12 clears teeth 6 and 7 of the second hammer 1 and then trip spring 14 associated with hammer 1 thrusts the hammer 1 in a counterclockwise direction to fire the second barrel.

While recoil and counter-recoil of the weapon exacerbates and aids separation of the inertia block 50 and pawl 60 of holding means 58, the release of the finger pull 71 of the trigger assembly and consequent counterclockwise rotation of inertia block 50 under the urging of spring 60, wherein pintle 84 first strikes the obstructing lug or ear 86 inserted in its path of rotation, and then overrides the top of the same is sufficient in and of itself to enable the pawl 60 to be freed and first rotate in a counterclockwise direction under urging of spring 61 relative to the inertia block 50 to clear head 62.

After firing the weapon the breech is opened and after loading, reclosed, causing a pair of push rods 98 (see FIG. 2) to contact and cause counterclockwise rotation of a pair of cams 99 which strike the bottom of each hammer 1 and 1' and rotates them in a clockwise direction about the axis of pin 3 against trip springs 14 to recock and arm the hammers as is well known in the art.

I claim:

1. A double barrelled shotgun comprising:

two hammers, one for firing each barrel, a spring urging each hammer from a cocked to a fired position, sear means for holding each hammer in a cocked position associated with each of said hammers, and manually-operable pivoted trigger means for successively actuating said sear means associated with each of said hammers to successively release each hammer to fire the same, said trigger means including fixed selector means for firing one of said barrels by contact with one of said sear means to transmit motion from said trigger means, when pivoted, to disengage said sear means from its associated hammer and permit its associated spring to urge said hammer to a fired position, an inertia-operated mass pivotally mounted on said trigger means, spring means urging said mass from a first position initially out of engagement with the other of said sear means to a second position in engagement with the other of said sear means, a spring-operated engagement member biasing said mass for resiliently holding said mass in its first position, said mass being adapted to be disengaged automatically from said engagement member when said mass is subjected to recoil and counter-recoil acceleration upon firing of the shotgun, thereby to move from its first to its second position, and cam means which upon pivoting of said trigger means froms an obstruction in the path of movement of said mass to assure disengagement of said engagement member and said mass upon the initial firing of said shotgun and movement of said mass from its first to its second position, said mass when in its second position, being movable, upon successive operation of said trigger means to disengage said other sear means from its associated hammer thereby causing firing of said second barrel.

2. The shotgun of claim 1 wherein said cam means includes a lug on one end thereof, and said mass includes a laterally extending pintle adapted to be positioned behind and in contact with said lug upon pivoting of said trigger means, and spring means urging said lug to a substantially upright position into the path of movement of said pintle, whereby upon movement of said mass from its first towards its second position said pintle will strike said lug to enable said engagement member to move away from said mass under the urging of its spring to release said mass, and said lug is adapted to rotate against said lug spring means when contacted by said pintle to permit said pintle to override said lug and said mass to move from said first to said second position upon release of said trigger means and engagement member from said mass.

3. The shotgun of claim 2 wherein the sear means includes a pair of trip levers each having a first portion facing upwardly and including a frontwardly directed projection for releasing said hammers, said trip levers being pivoted on a common pin, a pair of axially elongated trip springs acting on said hammers for displacement thereof to fire each barrel of said shotgun, and a tripping mechanism including trip teeth formed on a rearwardly facing surface of each of said hammers, said teeth being engaged by said projection on said trip levers, and said sear means including a sear lever between one of said trip levers and said fixed selector means in contact therewith for rotating said one trip lever to release a hammer.

4. The shotgun of claim 3 wherein said mass, when in its second position, is in engagement with a second, rear portion of each of said trip levers and is adapted to rotate the same, upon successive pivoting of said trigger means.

5. The shotgun of claim 4 including means on one of said hammers for contact with said engagement member upon moving said hammers to a cocked position to urge said mass backward to said first position.

* * * * *